US008726457B2

(12) United States Patent
Liu et al.

(10) Patent No.: US 8,726,457 B2
(45) Date of Patent: May 20, 2014

(54) VACUUM CLEANER WITH DISPLAY

(75) Inventors: Andrew Q. Liu, Twinsburg, OH (US); Susan S. Roberts, Louisville, OH (US); Steven W. Kostreba, Eastlake, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 142 days.

(21) Appl. No.: 13/340,898

(22) Filed: Dec. 30, 2011

(65) Prior Publication Data

US 2013/0167320 A1 Jul. 4, 2013

(51) Int. Cl.
*A47L 9/28* (2006.01)

(52) U.S. Cl.
USPC ..... 15/339; 15/319

(58) Field of Classification Search
USPC ..... 15/319, 339; 345/659, 658
See application file for complete search history.

(56) References Cited

U.S. PATENT DOCUMENTS

| | | | | |
|---|---|---|---|---|
| 2,045,496 | A | 6/1936 | Skinner | |
| 3,766,595 | A | 10/1973 | Valbona et al. | |
| 3,936,904 | A | 2/1976 | Bashark | |
| 4,199,838 | A | 4/1980 | Simonsson | |
| 4,747,213 | A | 5/1988 | Armstrong | |
| 4,817,234 | A | 4/1989 | Greulich | |
| 5,023,973 | A | 6/1991 | Tsuchida et al. | |
| 5,033,151 | A | 7/1991 | Kraft et al. | |
| 5,301,385 | A | 4/1994 | Abe et al. | |
| 5,400,463 | A | 3/1995 | Attard et al. | |
| 5,507,067 | A | 4/1996 | Hoekstra et al. | |
| 5,542,146 | A | 8/1996 | Hoekstra et al. | |
| 5,868,710 | A | 2/1999 | Battiato et al. | |
| 6,026,539 | A | 2/2000 | Mouw et al. | |
| 6,029,309 | A | 2/2000 | Imamura | |
| 6,044,520 | A * | 4/2000 | Yamamoto | 15/390 |
| 6,167,588 | B1 | 1/2001 | Dyson | |
| 6,363,571 | B1 * | 4/2002 | Block et al. | 15/335 |
| 6,571,422 | B1 | 6/2003 | Gordon et al. | |
| 6,646,626 | B1 | 11/2003 | Uskali et al. | |
| 6,800,140 | B2 | 10/2004 | Hansen | |
| 7,143,467 | B2 | 12/2006 | Seith | |

(Continued)

FOREIGN PATENT DOCUMENTS

| | | |
|---|---|---|
| EP | 1894507 | 3/2008 |
| EP | 2062517 | 5/2009 |
| GB | 2409634 | 7/2005 |
| JP | 2007167154 | 7/2007 |

OTHER PUBLICATIONS

PCT/US2012/069622 International Search Report and Written Opinion dated Apr. 16, 2013 (13 pages).
Windsor, Sensor S12, manual, (2002), 11 pages.

(Continued)

*Primary Examiner* — Dung Van Nguyen
(74) *Attorney, Agent, or Firm* — Michael Best & Friedrich LLP

(57) ABSTRACT

A vacuum cleaner includes a foot, a handle pivotally attached to the foot, a suction source, and a display disposed on one of the handle and the foot. The foot includes a suction nozzle. The handle is pivotal relative to the foot about an axis of rotation. The suction source is in fluid communication with the suction nozzle. The display is for displaying content in a first orientation relative to the display and a second orientation relative to the display based on the position of the handle relative to the foot. The second orientation is different than the first orientation.

20 Claims, 6 Drawing Sheets

(56) References Cited

U.S. PATENT DOCUMENTS

| | | | | |
|---|---|---|---|---|
| 7,170,534 | B2 | 1/2007 | Son et al. | |
| 7,174,604 | B2 | 2/2007 | Yoo et al. | |
| 7,220,930 | B2 | 5/2007 | Gordon et al. | |
| 7,350,266 | B2 * | 4/2008 | Park et al. | 15/410 |
| 7,418,763 | B2 | 9/2008 | Shaver et al. | |
| 7,461,430 | B2 | 12/2008 | Reick-Mitrisin et al. | |
| 7,509,707 | B2 | 3/2009 | Pullins | |
| 7,673,368 | B2 | 3/2010 | Cloud, III | |
| 7,690,077 | B2 | 4/2010 | Biere | |
| 7,757,344 | B2 * | 7/2010 | Min et al. | 15/353 |
| 7,898,429 | B2 | 3/2011 | Hwang et al. | |
| 7,913,353 | B2 | 3/2011 | Park et al. | |
| 2002/0126110 | A1 | 9/2002 | Bowron | |
| 2004/0083571 | A1 | 5/2004 | Yoo et al. | |
| 2005/0236012 | A1 | 10/2005 | Josefsson et al. | |
| 2006/0203014 | A1 | 9/2006 | Lev et al. | |
| 2007/0094840 | A1 | 5/2007 | Zahuranec | |
| 2007/0100282 | A1 | 5/2007 | Small et al. | |
| 2007/0214596 | A1 | 9/2007 | Bax | |
| 2007/0214597 | A1 | 9/2007 | Suzuki | |
| 2008/0016646 | A1 | 1/2008 | Gagnon et al. | |
| 2009/0101047 | A1 | 4/2009 | Mulaw et al. | |
| 2009/0109242 | A1 | 4/2009 | Kuo et al. | |
| 2009/0167653 | A1 | 7/2009 | Lin | |
| 2009/0174658 | A1 | 7/2009 | Blatchley et al. | |
| 2012/0152280 | A1 * | 6/2012 | Bosses et al. | 134/6 |

OTHER PUBLICATIONS

Windsor Industries, Inc., Windsor's Online Ordering, http://web.archive.bibalex.org/web/20030208092211/www.windsorind.com/documents.shtm (2003), 6 pages, Englewood.

Windsor, Sensor XP, manual, (2008), 4 pages.

Windsor, Sensor S, manual, (2009), 2 pages.

* cited by examiner

VACUUM CLEANER WITH DISPLAY

BACKGROUND OF THE INVENTION

The present invention relates to vacuum cleaners and more particularly to vacuum cleaners with displays.

SUMMARY OF THE INVENTION

The present invention provides, in one aspect, a vacuum cleaner including a foot, a handle pivotally attached to the foot, a suction source, and a display disposed on one of the handle and the foot. The foot includes a suction nozzle. The handle is pivotal relative to the foot about an axis of rotation. The suction source is in fluid communication with the suction nozzle. The display is for displaying content in a first orientation relative to the display and a second orientation relative to the display based on the position of the handle relative to the foot. The second orientation is different than the first orientation.

The present invention provides, in another aspect, a method of orienting content on a display of a vacuum cleaner. The vacuum cleaner includes a foot and a handle pivotally attached to the foot. The method including displaying content on the display at a first orientation relative to the display and at a second orientation relative to the display different from the first orientation based upon the position of the handle relative to the foot.

The present invention provides, in another aspect, a vacuum cleaner including a foot, a handle pivotally attached to the foot, a suction source, a dirt collector, a controller, a switch coupled to the controller, and a display disposed on the handle and coupled to the controller. The foot includes a suction nozzle. The handle is pivotal about an axis of rotation to an upright position and an inclined position. The suction source is in fluid communication with the suction nozzle. The suction source provides suction to draw dirty air into the vacuum cleaner through the suction nozzle. The dirt collector is configured to receive the dirty air from the suction nozzle, remove dirt from the dirty air, and store the removed dirt. The switch provides an input signal to the controller. The input signal indicates the position of the handle relative to the foot. The display includes a display surface on which content is displayed. The display is instructed by the controller in response to the input signal to display the content at a first orientation relative to the display when the handle is in the upright position and to display the content at a second orientation relative to the display when the handle is in the inclined position. The second orientation is rotated one-hundred eighty degrees relative to the first orientation.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 2:
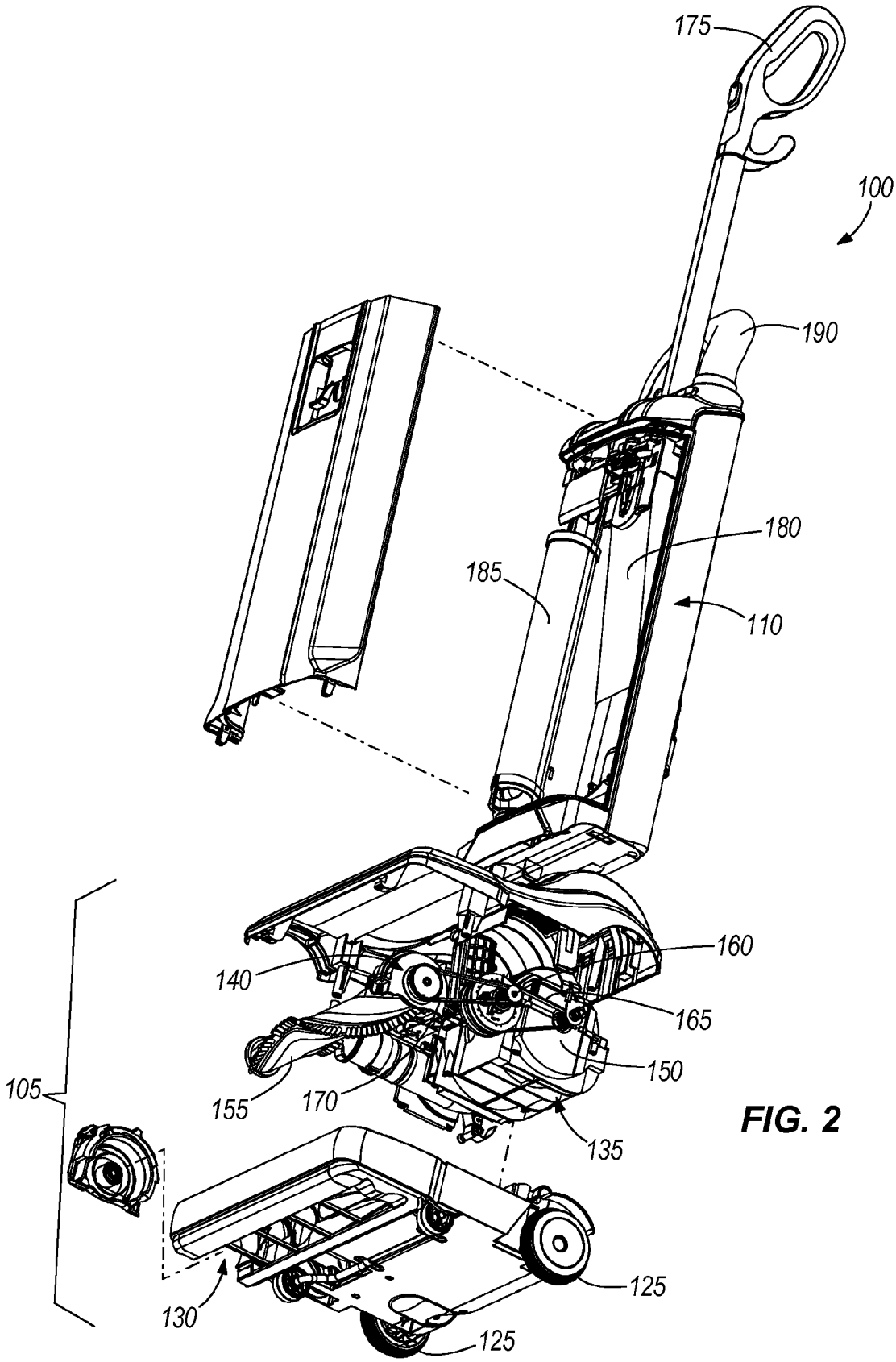
FIG. 2 is an exploded view of the vacuum cleaner of FIG. 1.
Figure 3:
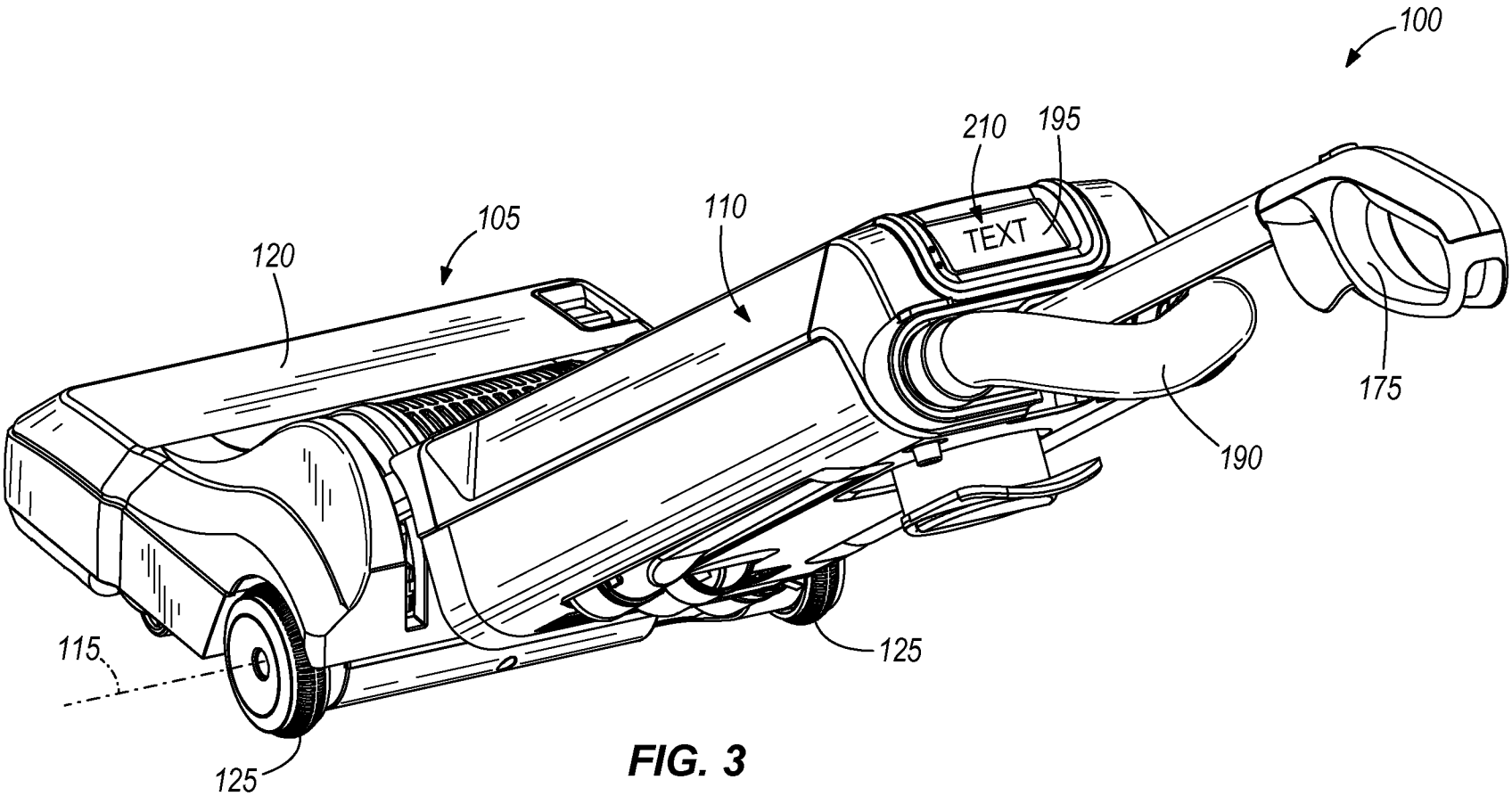
FIG. 3 is a rear perspective view of the vacuum cleaner of FIG. 1 with the handle in an inclined position.
Figure 4:
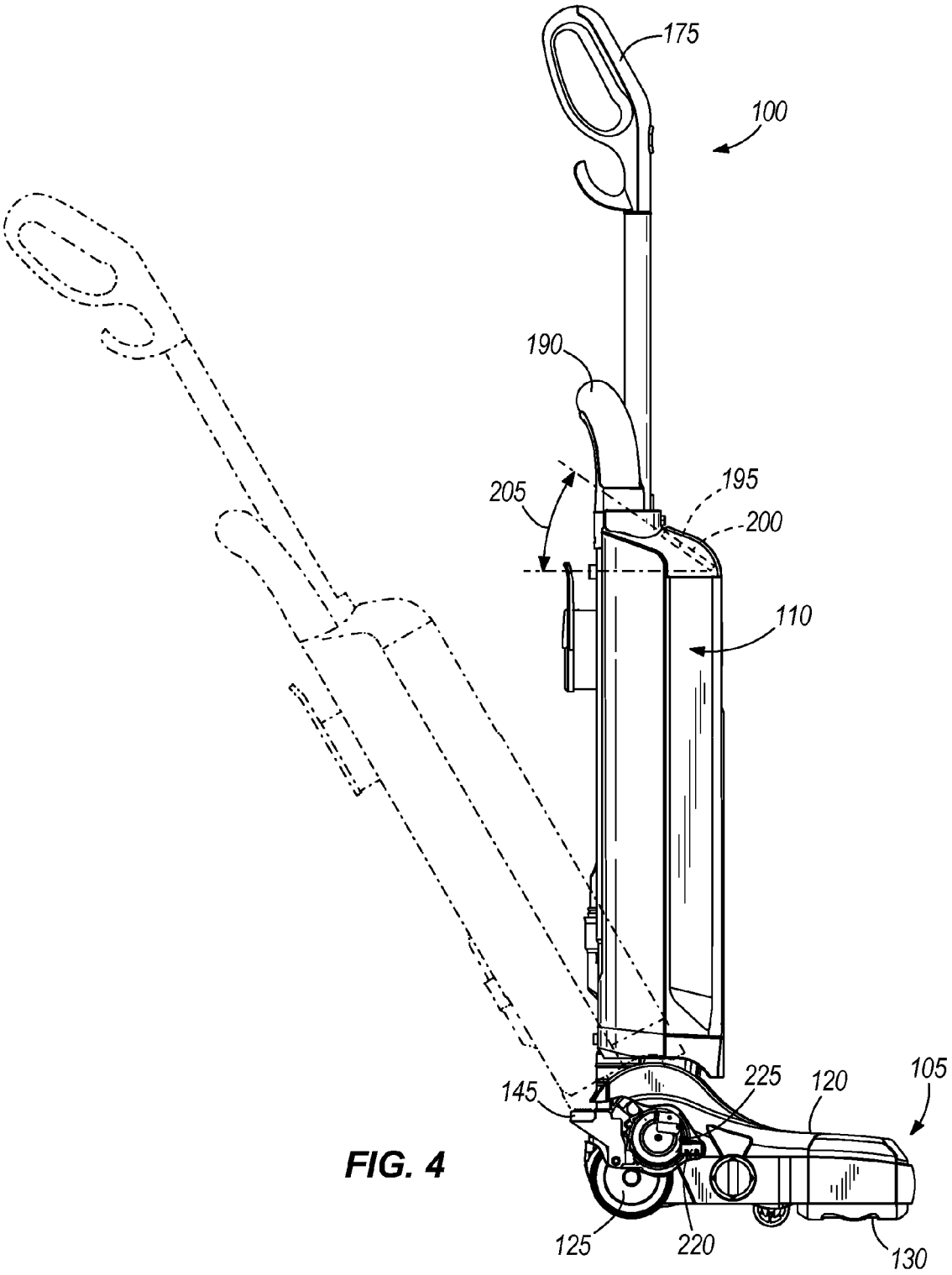
FIG. 4 is a side view of the vacuum cleaner of FIG. 1 with the handle in the upright position shown in solid lines and with the handle in the inclined position shown in dashed lines.

FIGS. 1-4 illustrate a vacuum cleaner 100 that includes a foot 105 and a handle 110. The foot 105 and the handle 110 are pivotally connected to one another such that the handle 110 pivots relative to the foot 105 about an axis of rotation 115. As shown in FIG. 4, the handle 110 is pivotal relative to the foot 105 between an upright position (shown in solid lines) and a number of inclined positions (one of which is shown in dashed lines).

Figure 1:
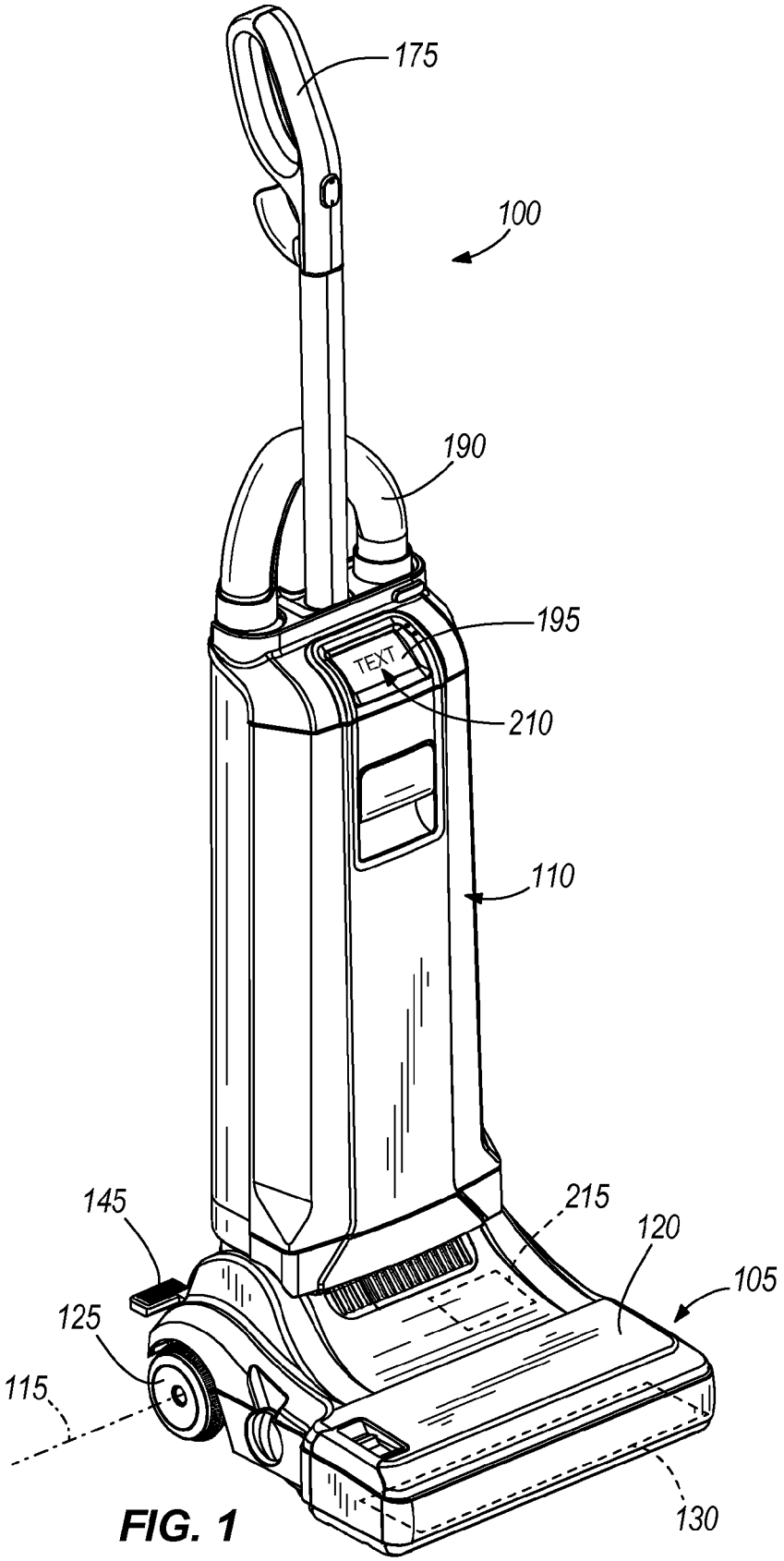
FIG. 1 is a front perspective view of a vacuum cleaner with a handle in an upright position.

As shown in FIGS. 1 and 2, the foot 105 includes a body 120, a pair of wheels 125, a suction nozzle 130, a suction source 135, a brushroll assembly 140, and a handle locking pedal 145. The pair of wheels 125 are rotatably mounted to the body 120 such that vacuum cleaner 100 can be pushed along a surface. The suction nozzle 130 forms an opening in the bottom of the body 120 and allows a dirty air stream to be drawn into the vacuum cleaner 100. The suction nozzle 130 is in fluid communication with the suction source 135. The suction source 135 includes a motor 150 and is configured with a fan for creating a vacuum. The brushroll assembly 140 includes a brushroll 155, a pulley assembly 160, a motor belt 165, and a brush belt 170. The brushroll 155 is rotatably secured to the body 120 and positioned within the suction nozzle 130. The rotatable pulley assembly 160 is positioned between the motor 150 and the brushroll 155. The motor belt 165 is connected between the motor 150 and the pulley assembly 160 such that the motor 150 is operable to rotate the pulley assembly 160. The brush belt 170 is connected between the pulley assembly 160 and the brushroll 155 such that rotation of the pulley assembly 160 rotates the brushroll 155. The handle locking pedal 145 locks the handle 110 in the upright position. The handle locking pedal 145 is depressed to unlock the handle 110, thereby allowing the handle 110 to pivot from the upright position to the inclined positions.

For the purposes of the present specification, all spatial and directional terms shall, unless specifically stated otherwise, refer to space and direction relative to the vacuum cleaner 100 in the vacuum cleaner's intended operational orientation on a flat, horizontal surface-to-be-cleaned, as shown in FIG. 1. In ordinary operation, the vacuum cleaner 100 is intended to be oriented with the wheels 125 in contact with the surface-to-be-cleaned. The term "forward" and variations thereon shall mean in a direction parallel to the direction from the wheels 125 toward the suction nozzle 130. The term "front" and variations thereon shall mean positioned further in the forward direction than an element being compared. The term "reverse" and variations thereon shall mean in a direction parallel to the direction from the suction nozzle 130 toward the wheels 125. The terms "rear" and "behind" and variations thereon shall mean positioned further in the reverse direction than an element being compared.

As shown in FIGS. 1 and 2, the handle 110 includes a hand grip 175, a dirt collector 180, a filter 185, an accessory hose 190, and a display 195. The dirt collector 180 is in fluid communication with the suction nozzle 130 and the suction source 135. As illustrated in FIG. 2, the dirt collector 180 is a vacuum bag that both removes dirt from a dirty air stream and collects the removed dirt. Alternatively, the dirt collector 180 can be a cyclonic separator and dirt cup assembly or other device suitable for removing dirt from a dirty air stream and collecting the removed dirt. The filter 185 is positioned in an air flow path between the suction source 135 and the dirt collector 180 to filter out additional dirt and other particulates that were not removed by the dirt collector 180. Alternatively, the filter 185 is positioned downstream of the suction source 135 or a second filter is positioned downstream of the suction source 135. The accessory hose 190 is in fluid communication with the dirt collector 180 and the suction source 135. An inlet of the accessory hose 190 allows a dirty air stream to be drawn into the vacuum cleaner 100 through the accessory hose 190.

As shown in FIG. 4, the display 195 includes a display surface 200. The display surface 200 is positioned at an acute angle 205 to horizontal when the handle 110 is in the upright position. Preferably, the angle 205 is thirty degrees. Alternatively, the angle 205 is equal to or less than forty-five degrees. As shown in FIGS. 1, 3, and 5-6, the display 195 is configured to display content 210 on the display surface 200. The content 210 can be text, images, or a combination of the two that indicate information about the vacuum cleaner 100 to the user. Examples of content 210 include: a percentage indicating how full the dirt collector 180 is, a percentage indicating how full the filter 185 is, a runtime counter indicating the total runtime on the brushroll 155, an indicator that the dirt collector 180 needs to be changed or emptied, an indicator that the filter 185 needs to be replaced or cleaned, an indicator that the motor 150 has overheated, an indicator that the suction nozzle 130 is clogged, an indicator that the filter 185 is clogged, an indicator that the accessory hose 190 is clogged, an indicator that the brush belt 170 is broken, an indicator that motor belt 165 is broken, an indicator that the brushroll 155 is stuck or jammed, and an indicator that the brushroll 155 needs to be replaced. Alternately, the display 195 is disposed on the foot 105.

Figure 5:
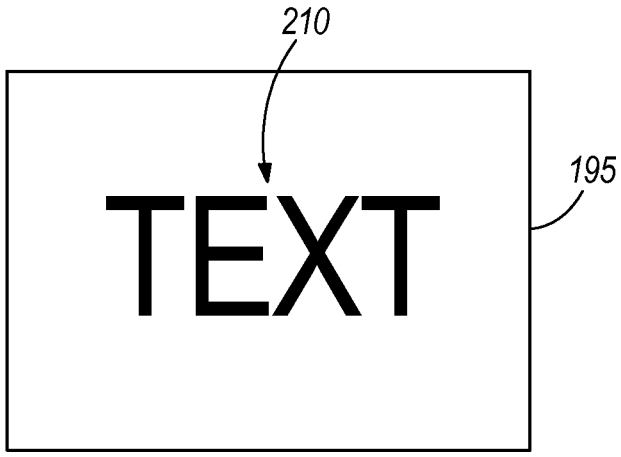
FIG. 5 is a front view of a display screen of the vacuum cleaner of FIG. 1 with content displayed in a first orientation.
Figure 6:
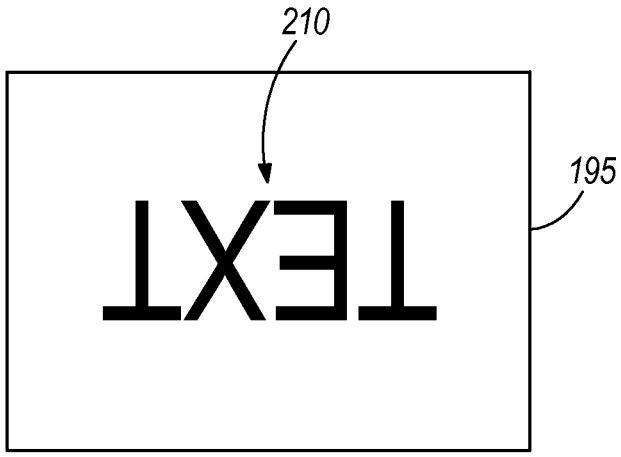
FIG. 6 is a front view of the display screen of FIG. 5 with content displayed in a second orientation.

As shown in FIGS. 1, 3, and 5-6, the content 210 is displayed on the display 195 at different orientations relative to the display 195 depending on the position of the handle 110 relative to the foot 105. As shown in FIGS. 1 and 5, when the handle 110 is in the upright position, the content 210 is displayed at a first orientation in which the content 210 is readable by a user positioned in front of the vacuum cleaner 100 and facing the display 195. The angle 205 of the display surface 200 allows the user to read the content 210 when the user is in front of the vacuum cleaner 100 with the handle 110 in the upright position. As shown in FIGS. 3 and 6, when the handle 110 is in an inclined position, the content 210 is displayed at a second orientation in which the content 210 is readable by a user positioned behind the vacuum cleaner 100 and facing the display 195. The angle 205 of the display surface 200 allows the user to read the content 210 when the user is behind the vacuum cleaner 100 with the handle 110 in an inclined position. Preferably, as shown in FIGS. 5-6, the second orientation (FIG. 6) is rotated one-hundred eighty degrees relative to the first orientation (FIG. 5). Alternatively, the second orientation can be rotated at least ninety degrees relative to the first orientation or rotated between one-hundred seventy degrees and one-hundred ninety degrees relative to the first orientation.

Figure 7:
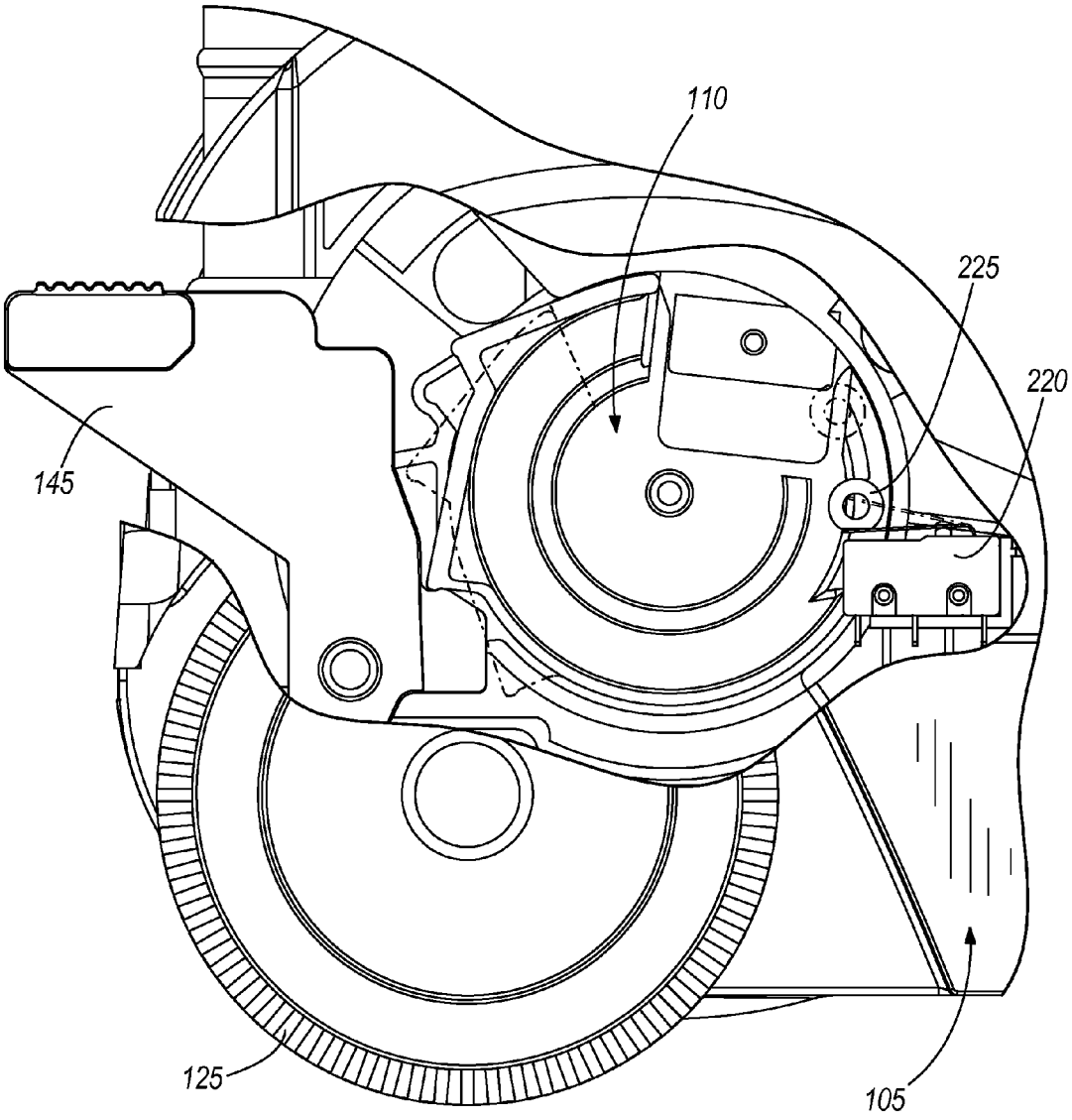
FIG. 7 is a detail view of a portion of the vacuum cleaner of FIG. 4.

A controller 215 (shown in FIG. 1) is used to control the display 195. As shown in FIGS. 4 and 7, a switch 220 is used to detect the position of the handle 110 relative to the foot 105 and to indicate to the controller 215 the position of the handle 110 relative to the foot 105 via an input signal. The display 195 and the switch 220 are coupled to the controller 215. The controller 215 can be a component of the foot 105, of the handle 110, or of the display 195 itself. The controller 215 includes a processor, a memory for storing instructions executable by the processor, and various inputs and outputs. The inputs and outputs allow for communication between the controller 215, the switch 220, the display 195, and the user. In some instances, the controller 215 is or includes a microprocessor, digital signal processor (DSP), field programmable gate array (FPGA), application specific integrated circuit (ASIC), and/or other similar components.

As shown in FIG. 7, the switch 220 is disposed on the foot 105 and a switch actuator 225 is disposed on the handle 110. Alternatively, the switch 220 is disposed on the handle 110 and the switch actuator 225 is disposed on the foot 105. The switch actuator 225 is configured to trigger the switch 220 when the handle 110 is in the upright position. Alternatively, the switch actuator 225 is configured to trigger the switch 220 when the handle 110 is in an inclined position. The switch 220 is coupled to the controller 215 so that the switch 220 sends an input signal to the control. The input signal indicates when the handle 110 is in the upright position and when the handle 110 is not in the upright position. The handle 110 is considered to be an inclined position when the handle 110 is not in the upright position. The display 195 is instructed by the controller 215 in response to the input signal from the switch 220 to display the content 210 at the first orientation relative to the display 195 when the handle 110 is in the upright position and to display the content 210 at the second orientation relative to the display 195 when the handle 110 is in the inclined position. As illustrated, the switch actuator 225 mechanically triggers a contact switch. With the handle 110 in the upright position, the switch actuator 225 (shown in solid lines) is in contact with the switch 220 to trigger the switch 220. With the handle 110 in an inclined position, the switch actuator 225 (shown in dashed lines) is not in contact with the switch 220 and does not trigger the switch 220. Other switch 220 and switch actuator 225 combinations are possible, including a magnetic field sensor as the switch 220 and a magnet as the switch actuator 225 and a rotational position sensor as the switch 220 and a specific rotational position as detected by the switch 220 as the switch actuator 225.

In use, with the handle 110 in the upright position, the user can stand in front of the vacuum cleaner 100 to review the status of the vacuum cleaner 100 by reading the content 210 in the first orientation on the display 195. With the user standing behind the vacuum cleaner 100, the user grips the hand grip 175, depresses the handle locking pedal 145, and moves the handle 110 to an inclined position, causing the content 210 to be displayed on the display 195 at the second orientation so that the content 210 can be read by the user standing behind the vacuum cleaner 100. Rotation of the brushroll 155 agitates the surface-to-be-cleaned (for example, carpet) to dislodge dirt. The suction source 135 creates a vacuum that draws a dirty air stream into the vacuum cleaner 100 through the suction nozzle 130. The dirty air stream travels from the suction nozzle 130 to the dirt collector 180 where dirt is removed from the dirty air stream and the removed dirt is collected. The now clean air stream travels from the dirt collector 180 to the suction source 135 and is then exhausted from the vacuum cleaner 100. Alternatively, a dirty air stream is drawn into the vacuum cleaner 100 through the accessory hose 190.

Various features of the invention are set forth in the following claims.

What is claimed is:

1. A vacuum cleaner comprising:

a foot including a suction nozzle;

a handle pivotally attached to the foot, the handle pivotal relative to the foot about an axis of rotation;

a suction source in fluid communication with the suction nozzle; and a display disposed on one of the handle and the foot, the display for displaying content in a first orientation relative to the display and a second orientation relative to the display based on the position of the handle relative to the foot, the second orientation different than the first orientation.

2. The vacuum cleaner of claim 1, further comprising:

a controller; and a switch coupled to the controller, the switch providing an input signal to the controller, the input signal indicating the position of the handle;

wherein the handle is pivotable about the axis of rotation to an upright position and an inclined position; and wherein the display is coupled to the controller and the display is instructed by the controller in response to the input signal to display the content at the first orientation when the handle is in the upright position and to display the content at the second orientation when the handle is in the inclined position.

3. The vacuum cleaner of claim 2, wherein the handle includes a switch actuator; and wherein the switch is disposed on the foot and is triggered by the switch actuator when the handle is in the upright position.

4. The vacuum cleaner of claim 2, wherein the foot includes a switch actuator; and wherein the switch is disposed on the handle and is triggered by the switch actuator when the handle is in the upright position.

5. The vacuum cleaner of claim 2, wherein the handle includes a switch actuator; and wherein the switch is disposed on the foot and is triggered by the switch actuator when the handle is in the inclined position.

6. The vacuum cleaner of claim 2, wherein the foot includes a switch actuator; and wherein the switch is disposed on the handle and is triggered by the switch actuator when the handle is in the inclined position.

7. The vacuum cleaner of claim 1, wherein the second orientation is rotated at least ninety degrees relative to the first orientation.

8. The vacuum cleaner of claim 7, wherein the second orientation is rotated between one-hundred seventy degrees and one-hundred ninety degrees relative to the first orientation.

9. The vacuum cleaner of claim 8, wherein the second orientation is rotated one-hundred eighty degrees relative to the first orientation.

10. The vacuum cleaner of claim 1, wherein the display further comprises a display surface, the display surface positioned at an acute angle relative to horizontal when the handle is in the upright position.

11. The vacuum cleaner of claim 10, wherein the acute angle is equal to or less than forty-five degrees.

12. The vacuum cleaner of claim 11, wherein the acute angle is thirty degrees.

13. A method of orienting content on a display of a vacuum cleaner, the vacuum cleaner including a foot and a handle pivotally attached to the foot, the method comprising:

displaying content on the display at a first orientation relative to the display and at a second orientation relative to the display different from the first orientation based upon the position of the handle relative to the foot.

14. The method of claim 13, further comprising:

displaying content on the display at the first orientation when the handle is at an upright position; and displaying content on the display at the second orientation when the handle is at an inclined position.

15. The method of claim 13, wherein the second orientation is rotated at least ninety degrees relative to the first orientation.

16. The vacuum cleaner of claim 15, wherein the second orientation is rotated one-hundred eighty degrees relative to the first orientation.

17. The method of claim 13, further comprising:

attaching the display to the handle such that a display surface of the display is positioned at an acute angle relative to horizontal when the handle is in the upright position.

18. The method of claim 17, wherein the acute angle is equal to or less than forty-five degrees.

19. The method of claim 13, further comprising:

detecting the position of the handle relative to the foot with a switch;

providing an input signal from the switch to a controller, the input signal indicating the position of the handle;

instructing the display with the controller in response to the input signal such that the content is displayed at the first orientation when the handle is in the upright position and the content is displayed at the second orientation when the handle is in the inclined position.

20. A vacuum cleaner comprising:

a foot including a suction nozzle;

a handle pivotally attached to the foot, the handle pivotal about an axis of rotation to an upright position and an inclined position;

a suction source in fluid communication with the suction nozzle, the suction source providing suction to draw dirty air into the vacuum cleaner through the suction nozzle;

a dirt collector in fluid communication with the suction nozzle and the suction source, the dirt collector configured to receive the dirty air from the suction nozzle, remove dirt from the dirty air, and store the removed dirt;

a controller;

a switch coupled to the controller, the switch providing an input signal to the controller, the input signal indicating the position of the handle relative to the foot; and a display disposed on the handle and coupled to the controller, the display including a display surface on which content is displayed, the display instructed by the controller in response to the input signal to display the content at a first orientation relative to the display when the handle is in the upright position and to display the content at a second orientation relative to the display when the handle is in the inclined position, the second orientation rotated one-hundred eighty degrees relative to the first orientation.

* * * * *